US007674040B2

(12) United States Patent
Dowd et al.

(10) Patent No.: US 7,674,040 B2
(45) Date of Patent: Mar. 9, 2010

(54) RECLOSABLE BAG HAVING DOUBLE CLOSURE

(75) Inventors: Sean Edward Dowd, New Braunfels, TX (US); Herbert Zivkovic, Garden Ridge, TX (US); Mary Jane Zivkovic, legal representative, Garden Ridge, TX (US); Perry Malik, New Braunfels, TX (US)

(73) Assignee: Illinois Tool Works Inc., Glenview, IL (US)

( * ) Notice: Subject to any disclaimer, the term of this patent is extended or adjusted under 35 U.S.C. 154(b) by 480 days.

(21) Appl. No.: 11/648,313

(22) Filed: Dec. 29, 2006

(65) Prior Publication Data

US 2008/0159662 A1 Jul. 3, 2008

(51) Int. Cl.
*B65D 33/16* (2006.01)

(52) U.S. Cl. ..... 383/61.2; 383/63; 383/65

(58) Field of Classification Search ..... 383/61.2, 383/63, 65; 24/399, 433, 434, 585.1, 584.1, 24/585.12, DIG. 39, DIG. 40, DIG. 50
See application file for complete search history.

(56) References Cited

U.S. PATENT DOCUMENTS

| | | | | |
|---|---|---|---|---|
| 4,736,496 | A | 4/1988 | Fisher et al. | |
| 4,822,539 | A | 4/1989 | Tilman et al. | |
| 5,209,574 | A * | 5/1993 | Tilman | 383/63 |
| 5,211,481 | A | 5/1993 | Tilman | |
| 5,384,942 | A | 1/1995 | Siegel | |
| 5,509,734 | A * | 4/1996 | Ausnit | 383/63 |
| 5,618,111 | A * | 4/1997 | Porchia et al. | 383/63 |
| 5,718,024 | A * | 2/1998 | Robbins | 24/584.1 |
| 6,167,597 | B1 * | 1/2001 | Malin | 24/585.1 |
| 6,691,383 | B2 | 2/2004 | Linton | |
| 7,137,736 | B2 | 11/2006 | Pawloski et al. | |
| 2004/0234172 | A1 * | 11/2004 | Pawloski | 383/63 |
| 2004/0261229 | A1 | 12/2004 | Cisek | |
| 2005/0244083 | A1 * | 11/2005 | McMahon et al. | 383/63 |

FOREIGN PATENT DOCUMENTS

| | | |
|---|---|---|
| EP | 0666041 | 8/1995 |
| EP | 1431203 | 6/2004 |

* cited by examiner

*Primary Examiner*—Jes F Pascua
(74) *Attorney, Agent, or Firm*—Ostrager Chong Flaherty & Broitman P.C.

(57) ABSTRACT

A reclosable bag having two spaced-apart flexible closures and external finger guide ridges and/or pressure distribution ridges to facilitate their closure. The ridges lie in a region between the double closures and they extend generally parallel to each other and to the closures when the bag is in an empty and flat state. The pressure distribution ridges improve the finger pressure distribution by moving the applied forces closer to the closure profiles. When used in conjunction with external finger guide ridges, the pressure distribution ridges also improve the bearing surface of the external finger guide ridges with the thumb and forefinger of the person closing the bag.

11 Claims, 6 Drawing Sheets

PRODUCT SIDE

PRODUCT SIDE

PRODUCT SIDE

PRODUCT SIDE

RECLOSABLE BAG HAVING DOUBLE CLOSURE

TECHNICAL FIELD

This invention generally relates to reclosable bags for storing articles, foodstuff or other matter. In particular, the invention relates to reclosable bags of a type comprising a flexible receptacle and a flexible closure.

BACKGROUND

Reclosable bags are finding ever-growing acceptance as primary packaging, particularly as packaging for foodstuffs such as cereal, fresh fruit and vegetables, cold cuts, snacks and the like. Such bags provide the consumer with the ability to readily store, in a closed, if not sealed, package any unused portion of the packaged product even after the package is initially opened.

Reclosable bags typically comprise a flexible receptacle formed of two opposing walls equipped at the mouth with a plastic closure or fastener. Typically, a plastic closure for a reclosable bag includes a pair of interlockable profiled closure strips that are joined (e.g., by thermal crushing or ultrasonic welding) at opposite ends of the bag mouth. The closure strips are formed by extruding thermoplastic material out of orifices having the desired profiles. The profiles of interlockable extruded plastic closure strips can take on various configurations, e.g. interlocking rib and groove elements having so-called male and female profiles, interlocking alternating hook-shaped closure elements, etc. The profiles are shaped so that when they are aligned and pressed together into an engaging relationship, they form a continuous closure for the bag. The bag may be opened by pulling the walls apart, thereby separating the profiles.

When trying to close the bag, the profiles of the interlockable closure strips must be aligned and then force-fit or pressed together along their length. Because the plastic closure strips are flexible, it can be difficult for the consumer to align the interlockable closure profiles before causing those profiles to engage. For example, it is sometimes difficult to close a reclosable bag because the user's finger may drift off the profiles, resulting in the closing pressure not being directly applied to portions of the closure.

U.S. Pat. No. 5,211,481 discloses a reclosable bag having guide means that guide the fingers of a user when closing the bag, whereby the bag can be easily and securely closed. More specifically, the guide means include a respective pair of ribs on the outside of each wall, the ribs of each pair forming a valley therebetween, which valleys are respectively located directly behind the male and female closure profiles. The spacing between the ribs and their sizing are such that each valley is sized and shaped to act as a finger guide for the end user of the bag. Thus, as the user passes his finger and thumb along the valleys, the user's finger and thumb are directed towards the optimum positions for applying pressure for forcing the profiles together, thereby ensuring that the profiles interlock properly across the entire width of the bag.

Double-closure reclosable storage and freezer bags are commercially available. In general, the double closure in such bags comprises two flexible closures that are mutually parallel and spaced apart when the bag is empty and flat. Each closure in turn comprises a respective pair of interlockable closure strips. Because two pairs of closure strips need to be aligned, closing a bag having two closures may be more difficult than closing a bag having one closure. There is a need to provide means for facilitating the alignment and pressing together of two mutually closures installed in a reclosable bag.

SUMMARY

This disclosure is directed to a reclosable bag having two spaced-apart flexible closures and external finger guide ridges and/or pressure distribution ridges to facilitate their closure. The ridges lie in a region between the double closures and they extend generally parallel to each other and to the closures when the bag is in an empty and flat state. The pressure distribution ridges improve the finger pressure distribution by moving the applied forces closer to the closure profiles. When used in conjunction with external finger guide ridges, the pressure distribution ridges also improve the bearing surface of the external finger guide ridges with the thumb and forefinger of the person closing the bag.

One aspect is a reclosable bag comprising first and second walls joined at first and second sides thereof; first and second closure profiles projecting from the first wall, a first external finger guide ridge projecting from the first wall and disposed between the first and second closure profiles, third and fourth closure profiles projecting from the second wall, and a second external finger guide ridge projecting from the second wall and disposed between the third and fourth closure profiles, wherein the first and third closure profiles are mutually interlockable, and the second and fourth closure profiles are mutually interlockable.

Another aspect is a reclosable bag comprising first and second walls joined at first and second sides thereof; first and second closure profiles projecting from the first wall, a first pressure distribution ridge projecting from either the first wall or the second wall and disposed between the first and second closure profiles, third and fourth closure profiles projecting from the second wall, and a second pressure distribution ridge projecting from either the first wall or the second wall, wherein the first and third closure profiles are mutually interlockable, the second and fourth closure profiles are mutually interlockable, and the second pressure distribution ridge is disposed generally parallel to and spaced apart from the first pressure distribution ridge when the closure profiles are mutually interlocked.

A further aspect is a reclosable bag comprising first and second panels joined at first and second sides thereof; and first and second closure strips respectively joined to marginal portions of the first and second panels that extend from the first side to the second side, wherein the first closure strip comprises first and second closure profiles and a first external finger guide ridge disposed therebetween, and the second closure strip comprises third and fourth closure profiles and a second external finger guide ridge disposed therebetween, wherein the first and third closure profiles are mutually interlockable, and the second and fourth closure profiles are mutually interlockable.

Yet another aspect is a reclosable bag comprising first and second panels joined at first and second sides thereof; and first and second closure strips respectively joined to marginal portions of the first and second panels that extend from the first side to the second side, wherein the first closure strip comprises first and second closure profiles and a pressure distribution ridge disposed therebetween, and the second closure strip comprises third and fourth closure profiles, wherein the first and third closure profiles are mutually interlockable, and the second and fourth closure profiles are mutually interlockable.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION

In accordance with the embodiments disclosed herein, sliderless reclosable bags are provided with a flexible double closure and external finger guide ridges and/or pressure distribution ridges to facilitate closing. The external finger guide ridges extend generally parallel to the double closure when the bag is empty and flat. The external finger guide ridges are so positioned that as the user runs his thumb and finger along the valleys bounded by respective pairs of external finger guide ridges on opposite sides of the double closure, the user can feel whether the pairs of ridges are aligned, in which case the closures of the double closure will be aligned. As the user squeezes the two sides of the double closure together with his moving thumb and finger, the double closure can be incrementally closed along its length until entirely closed.

The idea of using external and/or internal ridges in conjunction with a double closure (e.g., an extruded plastic double zipper) has application in many different types of sliderless reclosable bags. For example, a double closure with external and/or internal ridges may be incorporated in a bag formed by extruding or co-extruding a web of packaging film having integral closure profiles and integral ridges. That web can be folded to bring complementary closure profiles into engagement. The folded web is then cut with a hot knife to form sealed sides of a bag. Alternatively, side seam areas could be formed in the folded web by application of heat, which side seam areas are then bisected to form separate bags. Alternatively, the double closure (with external and/or internal ridges) and the web of packaging film could be extruded separately and then joined by heat sealing.

Figure 1:
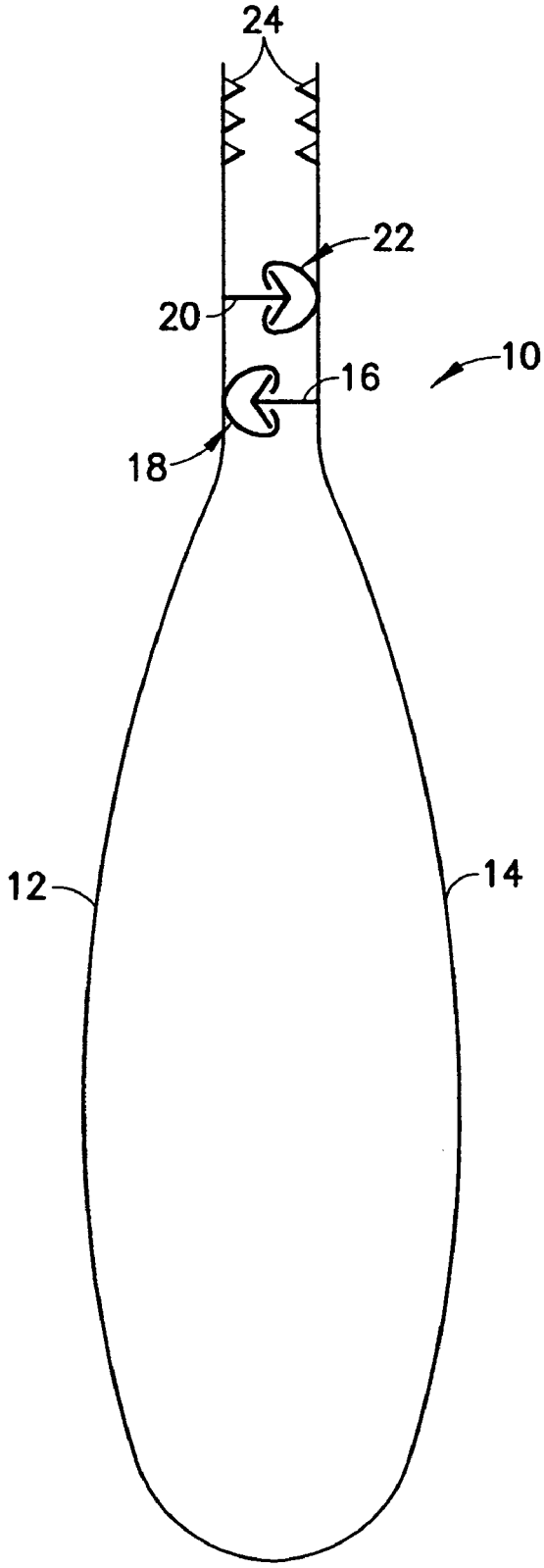
FIG. 1 is a drawing showing a cross-sectional view of a reclosable bag having a double closure.

FIG. 1 is a generalized depiction of a reclosable bag 10 that comprises a front wall 12 and a rear wall 14 formed by folding a sheet of bag-making film and then heat sealing the side edges of the front and rear walls to form a receptacle having a mouth portion. The bag 10 further comprises a double zipper comprising a male closure profile 16 interlocked with a female closure profile 18 and a male closure profile 20 interlocked with a female closure profile 22. The closure profiles extend the full width of the bag, except at the joined ends of the double zipper where the profiles are flattened (e.g., by thermal crushing or ultrasonic welding). Although male and female profiles are depicted in FIG. 1, the closure profiles can take on various configurations, e.g. interlocking rib and groove elements, interlocking alternating hook-shaped closure elements, and so forth. The profiles are shaped so that when they are aligned and pressed together into an engaging relationship, they form a continuous closure for the bag. The bag may be opened by pulling the walls apart, thereby separating the profiles. To facilitate gripping of the portions of walls 12 and 14 that form the bag mouth, a respective plurality of gripping ridges 24 can be formed on the interior surfaces of walls 12 and 14. Alternatively or additionally, gripping ridges could be formed on the exterior surfaces of the walls.

A person skilled in the art will appreciate that the bag 10 shown in FIG. 1 may be formed by extrusion or co-extrusion, such that the closure profiles and gripping ridges are integrally formed with the bag walls. In this example, the closure profiles 18 and 20 are integrally formed with and project from the front wall 12; the closure profiles 16 and 22 are integrally formed with and project from the rear wall 14. Alternatively, the double zipper may comprise separate extruded plastic closure strips that are respectively joined to the front and rear walls, e.g., by heat sealing. In the latter case, each closure strip will comprise a base strip with closure profiles and gripping ridges integrally formed therewith and projecting therefrom.

In accordance with various embodiments disclosed herein, the double zipper is provided with external finger guide ridges for facilitating closure of both zippers in one continuous motion. Some embodiments are shown in FIGS. 2-5 respectively. For the sake of clarity, only the mouth portion of each reclosable bag is shown in FIGS. 2-5 (on an enlarged scale as compared to FIG. 1).

Figure 2:
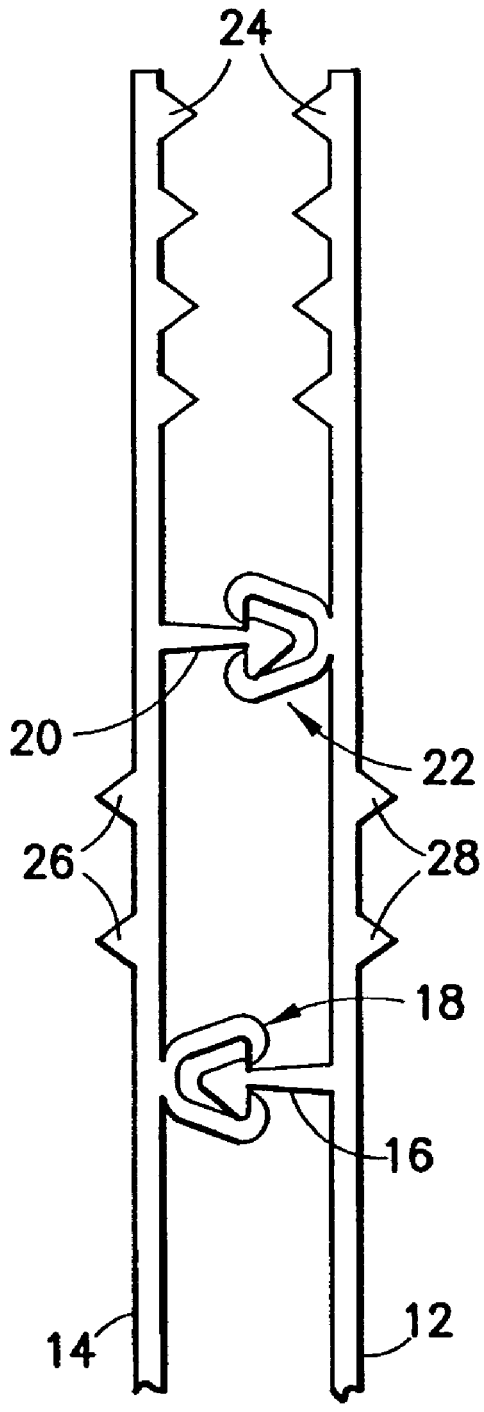
FIG. 2 is a drawing showing a cross-sectional view of a mouth portion of a reclosable bag having a double closure and external finger guide ridges.
Figure 3:
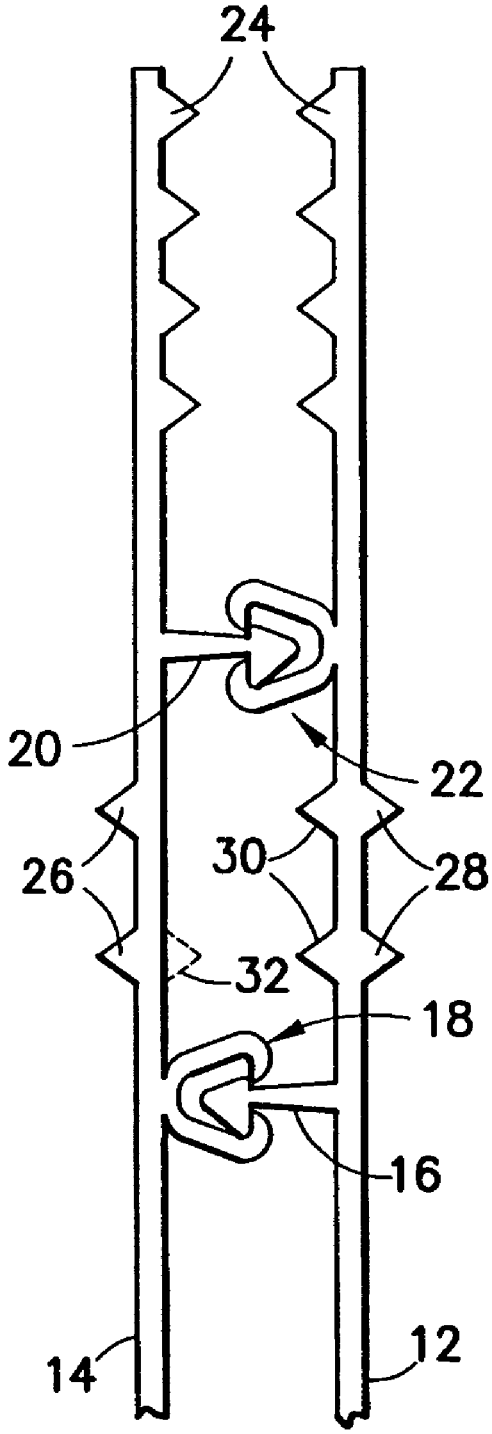
FIG. 3 is a drawing showing a cross-sectional view of a mouth portion of a reclosable bag having a double closure, external finger guide ridges and pressure distribution ridges.

FIG. 2 shows the mouth portion of a reclosable bag having a double zipper of the type previously described with reference to FIG. 1. The closure profiles 16 and 22 and a plurality of gripping ridges 24 are integrally formed with and project from the front wall 12; the closure profiles 18 and 20 and a plurality of gripping ridges 24 are integrally formed with and project from the rear wall 14. In addition, a first pair of external finger guide ridges 26 are integrally formed with and project from the rear wall 14, while a second pair of external finger guide ridges 28 are integrally formed with and project from the front wall 12. The external finger guide ridges 26 are disposed between the closure profiles 18 and 20, i.e., they project from the portion of wall 14 that spans the space that separates closure profiles 18 and 20. Similarly, the external finger guide ridges 28 are disposed between the closure profiles 16 and 22, i.e., they project from the portion of wall 12 that spans the space that separates closure profiles 18 and 20. Because ridges 26 and 28 are also formed by extrusion or co-extrusion, the ridges 26 are mutually parallel and extend the full width of the bag except where the ridges (and closure profiles) are flattened during joinder of the mouth portions of walls 12 and 14 at opposite ends of the double zipper. When the mouth is closed, the ridges 26 will be generally parallel to the ridges 28. Preferably, the distance separating the ridges 26 is approximately equal to the distance separating the ridges 28, and the uppermost ridge 26 is located at substantially the same elevation as that of the uppermost ridge 28.

Although FIG. 2 (and later drawings) depicts the external finger guide ridges as having a basically triangular profile, the profile of these ridges may have other geometric shapes, e.g., semicircular (or other curvature), trapezoidal (with or without rounded corners), rectangular (with or without rounded corners), etc. The peaks of the triangular ridges seen in FIG. 2 may be rounded.

Each pair of external finger guide ridges 26 and 28 form a respective valley therebetween. The user of the bag can place a thumb and a finger overlying a respective valley and then pass a thumb and a forefinger along the valleys, using contact with the external ridges 26 and 28 to guide their respective paths. When the feel of the ridges is such that the closure profiles are aligned, the user concurrently applies pressure with his continuously moving thumb and forefinger to force the respective sets of closure profiles into interlocking engagement.

In accordance with a further variation, additional external finger guide ridges may be provided. For example, additional external finger guide ridges could be formed on both walls at the respective elevations of the closure profiles.

In addition, pressure distribution ridges 30 (see FIG. 3) may be provided to improve the finger pressure distribution by moving the applied forces closer to the closure profiles. When used in conjunction with external finger guide ridges, the pressure distribution ridges also improve the bearing surface of the external finger guide ridges 26 and 28 with the thumb and forefinger of the person closing the bag. In the example depicted by solid lines in FIG. 3, a pair of pressure distribution ridges 30 are integrally formed with and project from the portion of front wall 12 that spans the space between closure profiles 16 and 22. Alternatively, the lowermost pressure distribution ridge could be placed on the other wall, as indicated by pressure distribution ridge 32 shown by dashed lines in FIG. 3. Or both pressure distribution ridges could be placed on rear wall 14. Regardless of whether one pressure distribution ridge is formed on each wall or both ridges are formed on the same wall, the pressure distribution ridges are preferable disposed at the same elevations as the corresponding external finger guide ridges. Because the pressure distribution ridges 30, 32 are also formed by extrusion or co-extrusion, the ridges 30, 32 are mutually parallel and extend the full width of the bag except where the pressure distribution ridges (and closure profiles and external ridges) are flattened during joinder of the mouth portions of walls 12 and 14 at opposite ends of the double zipper. When the mouth is closed, the pressure distribution ridges 30, 32 will be generally parallel to the external finger guide ridges 26 and 28. The pressure distribution ridges provide a backing for the external finger guide ridges to ensure that the latter remain in contact with the thumb and fingertips during the closing operation.

In accordance with a further variation, a pair of pressure distribution ridges may be provided on both walls of the bag, the pressure distribution ridges of each pair being respectively aligned with each other and with the corresponding external finger guide ridges.

Figure 4:
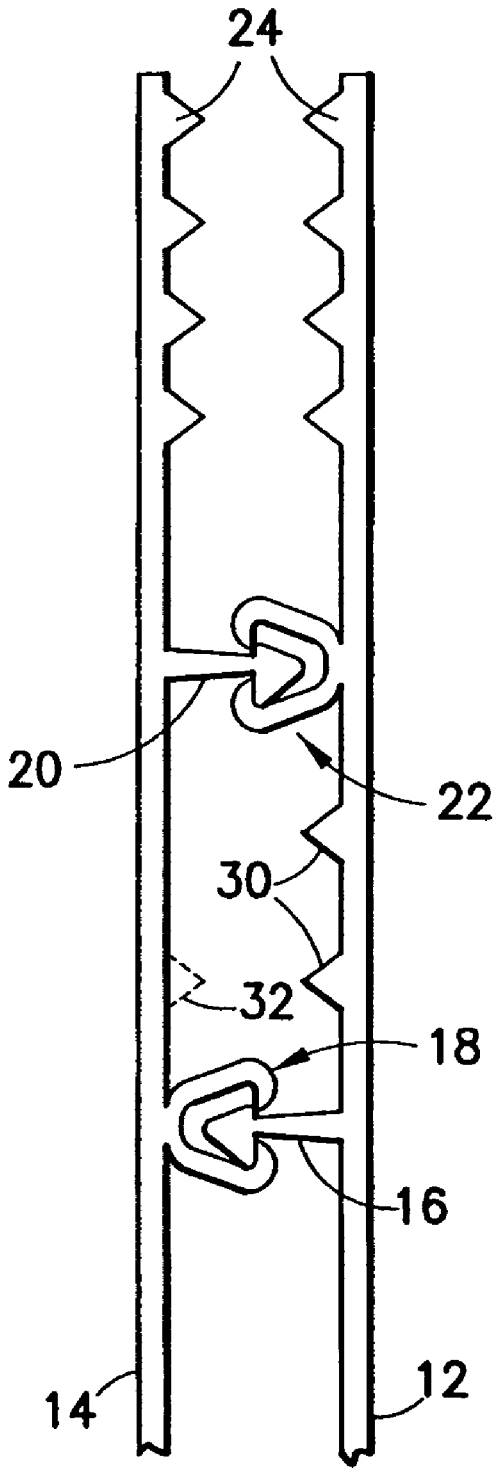
FIG. 4 is a drawing showing a cross-sectional view of a mouth portion of a reclosable bag having a double closure and pressure distribution ridges.

In accordance with a further alternative embodiment shown in FIG. 4, pressure distribution ridges 30 may be provided for improving the finger pressure distribution even in the absence of external finger guide ridges. In the example depicted by solid lines in FIG. 4, a pair of pressure distribution ridges 30 are integrally formed with and project from the portion of front wall 12 that spans the space between closure profiles 16 and 22. Alternatively, the lowermost pressure distribution ridge could be placed on the other wall, as indicated by pressure distribution ridge 32 shown by dashed lines in FIG. 4. Or both pressure distribution ridges could be placed on rear wall 14. Also, more than two pressure distribution ridges could be provided.

Figure 5:
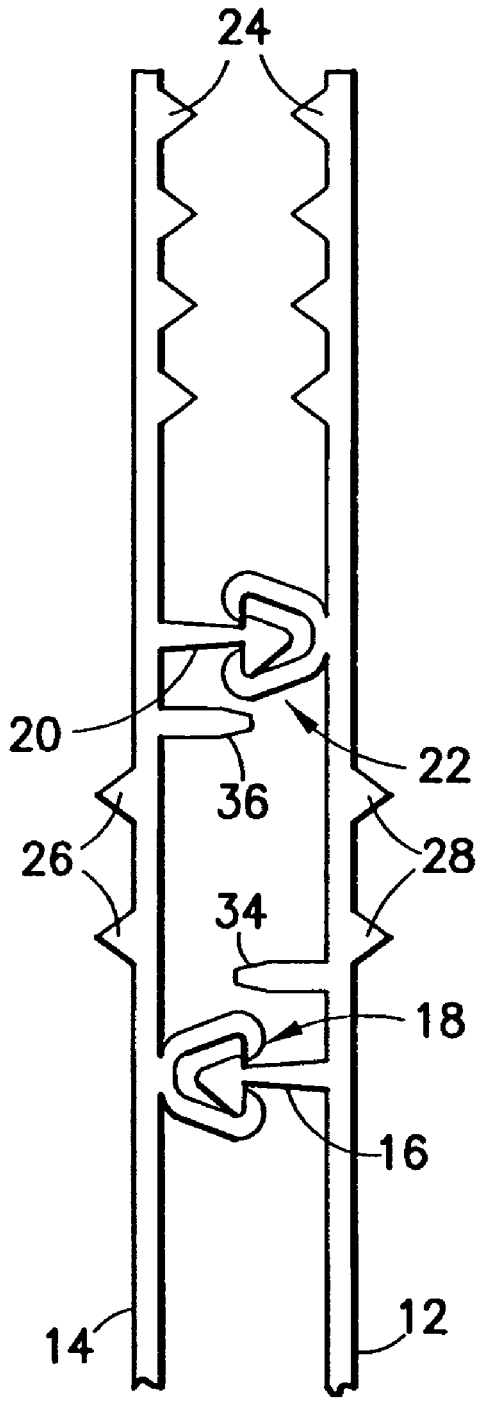
FIG. 5 is a drawing showing a cross-sectional view of a mouth portion of a reclosable bag having a double closure, external finger guide ridges and alignment ribs.

In accordance with a further alternative embodiment shown in FIG. 5, internal alignment ribs 34 and 36 may be provided for assisting in the alignment of the respective complementary sets of closure profiles. The alignment ribs also stiffen the area of the bag film occupied by the male profiles. In the example depicted in FIG. 5, a first alignment rib 34 is integrally formed with and projects from the front wall 12 in proximity to the male closure profile 16, while a second alignment rib 36 is integrally formed with and projects from the rear wall 14 in proximity to the male closure profile 20. The alignment ribs should be sized and shaped to interfere with one of the opposing female closure profiles whenever the closure profiles are misaligned during attempted closure. In the example, shown in FIG. 5, the alignment ribs are placed between the respective sets of closure profiles. Alternatively, additional alignment ribs can be placed outside the closure profiles, so that each male profile is flanked by a pair of alignment ribs, as shown in FIG. 1 of U.S. Pat. No. 4,822,539.

Because the alignment ribs 34 and 36 are also formed by extrusion or co-extrusion, the ribs 34 and 36 are mutually parallel and extend the full width of the bag except where the alignment ribs (and closure profiles and external ridges) are flattened during joinder of the mouth portions of walls 12 and 14 at opposite ends of the double zipper. When the mouth is closed, the alignment ribs 34 and 36 will be generally parallel to the external finger guide ridges 26 and 28.

The reclosable bags depicted in FIGS. 2-5 may be manufactured by tubular extrusion as taught in U.S. Pat. No. 4,822,539. Extruded bag making material comprising bag wall film may conveniently be extruded tubularly and then collapsed for interlocking the extruded closure profiles of the double zipper. In the collapsed condition, the bag making extrusion has a top end fold and a bottom end fold. The top end fold may be slit before or after the bag side seals are formed, thereby providing a bag having a mouth that is closed by the interlocked double zipper. A person skilled in the art will appreciate that closure profiles, gripping ridges, external finger guide ridges, pressure distribution ridges, and alignment ridges described above may be extruded or co-extruded with the bag making film. Furthermore, it will be understood that, as is customary practice, as the tubular film leaves the extrusion orifice, the tube can be expanded or reduced, e.g., by air pressure, to a desired diameter for producing when collapsed a bag making material of desired height and/or desired film gauge. Further, independent feed of extrudate permits use of dissimilar extrudate materials either as to density and stiffness.

As previously mentioned, instead of extruding or co-extruding the closure profiles and external finger guide ridges during extrusion of the bag making film, the double zipper may be extruded independent and then joined to the bag walls, e.g., by heat sealing. This can be done in numerous ways. For example, one zipper strip could be attached to one margin of the film and then the web of film is folded. After folding, a margin of the folded-over portion of the film is attached to the other zipper strip. Alternatively, a closed double zipper assembly is placed between the opposing margins of a folded web and both zipper strips are sealed to the web in one operation. In either case, after zipper attachment, the sides of the bag are sealed together before or during the cutting operation by which each bag is severed from the work in process. The ends of the zipper strips can be crushed and fused together to form a zipper with joined ends. This operation can be performed in an operation separate from the side sealing operation.

Figure 6:
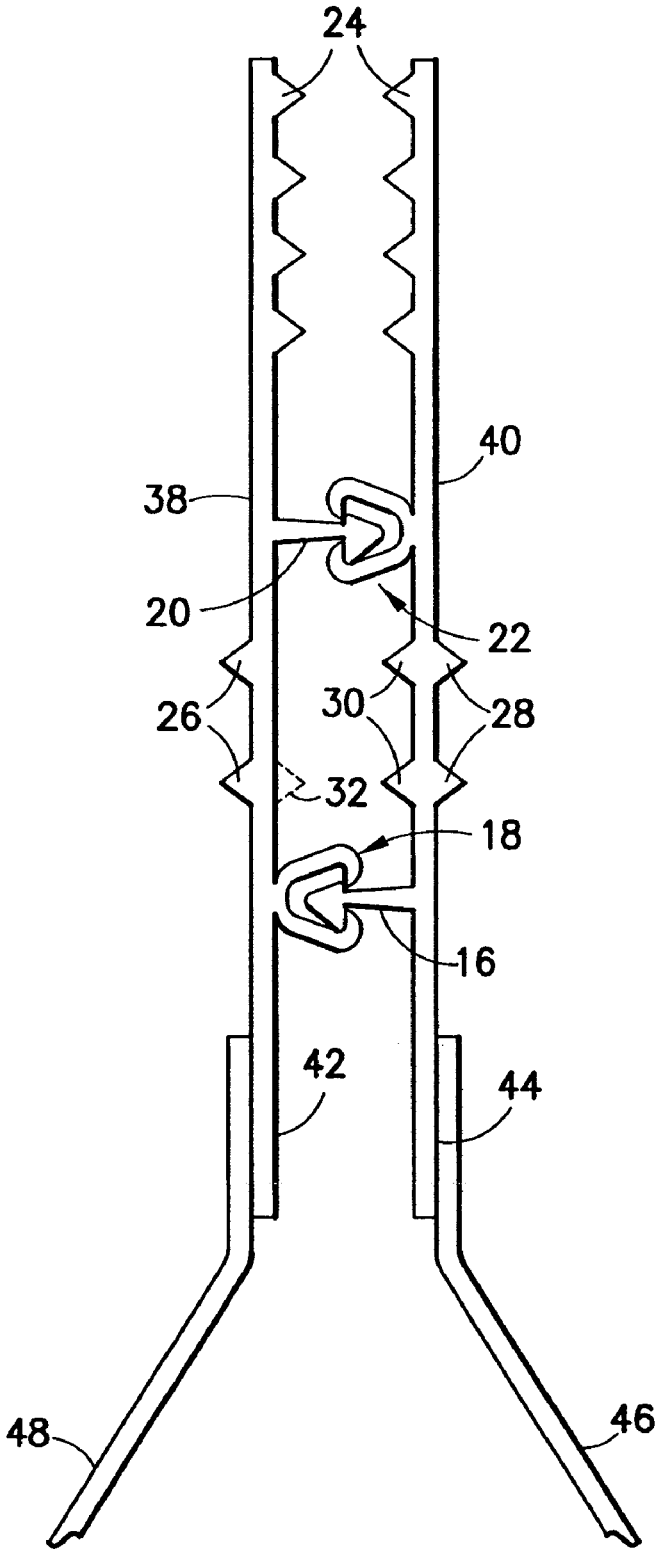
FIG. 6 is a drawing showing a cross-sectional view of a mouth portion of another reclosable bag having a double closure, external finger guide ridges and pressure distribution ridges.

One embodiment having an extruded plastic double zipper installed in a mouth portion of a bag is shown in FIG. 6. The double zipper comprises a pair of interlockable fastener or closure strips. One closure strip comprises a base strip 38 supporting the following integrally formed projections: female closure profile 18, male closure profile 20, a plurality of gripping ridges 24 and a pair of external finger guide ridges 26. The other closure strip comprises a base strip 40 supporting the following integrally formed projections: male closure profile 16, female closure profile 22, a plurality of gripping ridges 24 and a pair of external finger guide ridges 28. The base strip 31 has a lower flange portion 42 that is joined to a marginal portion of a rear panel 48 of a flexible receptacle, while the base strip 40 has a lower flange portion 44 that is joined to a marginal portion of a front panel 46 of the flexible receptacle. As used in the claims, the term "panel" is broad enough to include the front and rear portions of a web of bag making material that is folded at the bag bottom, as well as separate sheets of bag making material that have been joined together on three sides.

Again pressure distribution ridges 30 may be provided for improving the finger pressure distribution and improving the bearing surface of the external finger guide ridges. In the example depicted by solid lines in FIG. 6, a pair of pressure distribution ridges 30 are integrally formed with and project from the portion of base strip 40 that spans the space between closure profiles 16 and 22. Alternatively, the lowermost pressure distribution ridge could be placed on the other base strip 38, as indicated by pressure distribution ridge 32 shown by dashed lines in FIG. 6. Or both pressure distribution ridges could be placed on base strip 38.

For the embodiment depicted in FIG. 6, the preferred zipper material is polyethylene. However, a different plastic material, such as polypropylene, could be used. Although not shown in FIG. 6, the zipper strips are joined at opposite ends of the zipper, for example, by fusing the confronting ends of the zipper strips together by application of heat or ultrasound wave energy. The zipper strips may be joined to the upper marginal portions of the front and rear panels by means of respective layers of sealant material (not shown in FIG. 6) laminated to the backs of the base strips. This is typically accomplished by co-extruding the zipper strip and the sealant layer. The front and rear bag panels are respectively sealed to the zipper halves by heat fusion or welding (also referred to as "heat sealing"). Alternatively, the interlockable zipper strips can be attached to the panels by adhesive or bonding strips. The walls of the bag may be formed of various types of thermoplastic material, such as low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip or sealant layer or bead, etc.

The invention claimed is:

1. A reclosable bag comprising:

first and second walls joined at first and second sides thereof;

first and second closure profiles projecting inward from said first wall;

third and fourth closure profiles projecting inward from said second wall, wherein said first and third closure profiles are mutually interlockable, and said second and fourth closure profiles are mutually interlockable;

first and second external finger guide ridges projecting outward from said first wall at elevations disposed between said first and second closure profiles;

third and fourth external finger guide ridges projecting outward from said second wall at elevations disposed between said third and fourth closure profiles;

a first pressure distribution ridge projecting inward from said first wall at an elevation such that said first pressure distribution ridge provides backing for said third external finger guide ridge.

2. The bag as recited in claim 1, wherein said first and second closure profiles and said first and second external finger guide ridges are integrally formed with said first wall, and said third and fourth closure profiles and said third and fourth external finger guide ridges are integrally formed with said second wall.

3. The bag as recited in claim 1, wherein said first wall comprises a first panel and a first base strip, a marginal portion of said first panel being joined to a lower flange portion of said first base strip, and said second wall comprises a second panel and a second base strip, a marginal portion of said second panel being joined to a lower flange portion of said second base strip, said first and second closure profiles and said first and second external finger guide ridges being integrally formed with said first base strip, and said third and fourth closure profiles and said third and fourth external finger guide ridges being integrally formed with said second base strip.

4. The bag as recited in claim 1, wherein said first and fourth closure profiles are male profiles and said second and third closure profiles are female profiles.

5. The bag as recited in claim 1, further comprising:

a first plurality of mutually parallel gripping ridges projecting inward from said first wall on a consumer side of said first closure profile; and a second plurality of mutually parallel gripping ridges projecting inward from said second wall on a consumer side of said third closure profile.

6. The bag as recited in claim 1, further comprising a second pressure distribution ridge projecting inward from said first wall at an elevation such that said second pressure distribution ridge provides backing for said fourth external finger guide ridge.

7. The bag as recited in claim 1, further comprising a second pressure distribution ridge projecting inward from said second wall at an elevation such that said second pressure distribution ridge provides backing for said second external finger guide ridge.

8. A reclosable bag comprising first and second panels joined at first and second sides thereof; and first and second closure strips respectively comprising first and second base strips respectively joined to marginal portions of said first and second panels that extend from said first side to said second side, wherein said first closure strip further comprises:

first and second closure profiles projecting inward from said first base strip;

first and second external finger guide ridges projecting outward from said first base strip, said first and second external finger guide ridges being generally parallel to each other and to said first and closure profiles when said first base strip is in a generally planar state; and a first pressure distribution ridge projecting inward from said first base strip generally parallel to said first and second external finger guide ridges, said first and second external finger guide ridges and said first pressure distribution ridge being disposed on a portion of said first base strip that extends from said first closure profile to said second closure profile, and wherein said second closure strip comprises:

third and fourth closure profiles projecting inward from said second base strip, said first and third closure profiles being mutually interlockable, and said second and fourth closure profiles being mutually interlockable; and third and fourth external finger guide ridges projecting outward from said second base strip, said third and fourth external finger guide ridges being generally parallel to each other and to said third and fourth closure profiles when said second base strip is in a generally planar state, and said third and fourth external finger guide ridges being disposed on a portion of said second base strip that extends from said third closure profile to said fourth closure profile, wherein said first pressure distribution ridge projects inward from said first base strip at an elevation such that said first pressure distribution ridge provides backing for said third external finger guide ridge.

9. The bag as recited in claim 8, wherein said first closure strip further comprises a second pressure distribution ridge projecting inward at an elevation such that said second pressure distribution ridge provides backing for said fourth external finger guide ridge.

10. The bag as recited in claim 8, wherein said second closure strip further comprises a second pressure distribution ridge projecting inward at an elevation such that said second pressure distribution ridge provides backing for said second external finger guide ridge.

11. The bag as recited in claim 8, wherein said first base strip further comprises a first plurality of mutually parallel gripping ridges projecting inward on a consumer side of said first closure profile, and said second base strip further comprises a second plurality of mutually parallel gripping ridges projecting inward on a consumer side of said third closure profile.

* * * * *